US006439251B2

(12) United States Patent
Carter

(10) Patent No.: US 6,439,251 B2
(45) **Date of Patent: *Aug. 27, 2002**

(54) ERECTABLE SHELTER WITH GABLE ROOF

(76) Inventor: Mark C. Carter, 1601 Iowa Ave., Riverside, CA (US) 92507

( * ) Notice: Subject to any disclaimer, the term of this patent is extended or adjusted under 35 U.S.C. 154(b) by 0 days.

This patent is subject to a terminal disclaimer.

(21) Appl. No.: 09/770,999

(22) Filed: Jan. 25, 2001

Related U.S. Application Data

(63) Continuation of application No. 09/503,376, filed on Feb. 14, 2000, now Pat. No. 6,192,910, which is a continuation of application No. 09/131,148, filed on Aug. 7, 1998, now Pat. No. 6,041,800.

(51) Int. Cl.[7] ..... E04H 15/50
(52) U.S. Cl. ..... 135/158; 135/145; 135/131
(58) Field of Search ..... 135/145, 143, 135/158, 146, 131, 128, 144, 160

(56) References Cited

U.S. PATENT DOCUMENTS

| | | | | | |
|---|---|---|---|---|---|
| 1,712,836 | A | | 5/1929 | Mills | |
| 1,853,367 | A | | 4/1932 | Mace | |
| 3,455,310 | A | * | 7/1969 | Petersen | 135/147 X |
| 4,407,317 | A | | 10/1983 | Crandall | |
| 4,601,301 | A | | 7/1986 | Hermanson | |
| 4,607,656 | A | | 8/1986 | Carter | |
| 4,641,676 | A | | 2/1987 | Lynch | |
| 4,779,635 | A | * | 10/1988 | Lynch | 135/145 X |
| 4,885,891 | A | * | 12/1989 | Lynch | 135/145 X |
| 4,947,884 | A | | 8/1990 | Lynch | |
| 5,035,253 | A | | 7/1991 | Bortles | |
| 5,244,001 | A | | 9/1993 | Lynch | |
| 5,274,980 | A | | 1/1994 | Zeigler | |
| 5,275,188 | A | | 1/1994 | Tsai | |
| 5,421,356 | A | * | 6/1995 | Lynch | 135/145 |
| 5,485,863 | A | * | 1/1996 | Carter | 135/145 |
| 5,490,533 | A | | 2/1996 | Carter | |
| 5,632,292 | A | * | 5/1997 | Carter | 135/145 |
| 5,634,483 | A | | 6/1997 | Gwin | |
| 5,794,640 | A | | 8/1998 | Jang | |
| 5,813,425 | A | * | 9/1998 | Carter | 135/145 |
| 5,934,301 | A | * | 8/1999 | Carter | 135/145 |
| 6,041,800 | A | * | 3/2000 | Carter | 135/145 |
| 6,055,999 | A | * | 5/2000 | Grey | 135/147 |
| 6,129,102 | A | * | 10/2000 | Carter | 135/145 |
| 6,192,910 | B1 | * | 2/2001 | Carter | 135/145 |

FOREIGN PATENT DOCUMENTS

| | | |
|---|---|---|
| AU | 1992000025649 | 6/1992 |
| GB | 1993002258475 | 10/1993 |
| GB | 1998002320509 | 6/1998 |
| WO | 1993WO0013284 | 8/1993 |

* cited by examiner

*Primary Examiner*—Robert Canfield
(74) *Attorney, Agent, or Firm*—Fulwider, Patton, Lee & Utecht; James W. Paul, Esq.

(57) ABSTRACT

The collapsible shelter has a canopy that can be raised above the upper level of the leg assembly in an extended configuration. A perimeter truss linkage assembly connected to the leg assembly, and two or more central truss pairs of link members are provided, with each of the central truss pairs connected to the inner ends of one of the perimeter truss pairs on a side. At least one vertically oriented central support members for supporting the canopy above the upper level of the leg assembly is provided, and preferably three central support members are provided, including at least one vertically oriented inner central support member, and at least two peripheral central support members. The central support members comprise upper and lower telescoping sections, with the upper telescoping section having an upper end for supporting the canopy. The central support members have an internal stop member in their the lower telescoping section for supporting the upper telescoping section of the central support member, such that when the shelter is in the extended configuration, the lower telescoping section supports the upper telescoping section and raises the upper end of the upper telescoping section above the upper ends of the leg assembly.

5 Claims, 4 Drawing Sheets

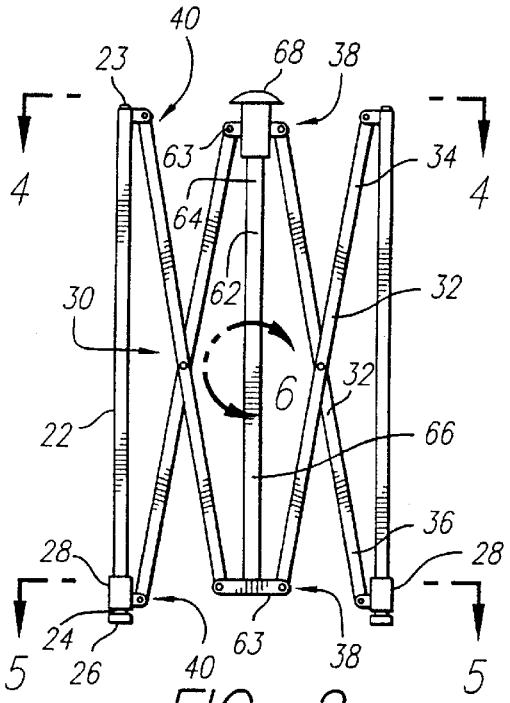
FIG. 2
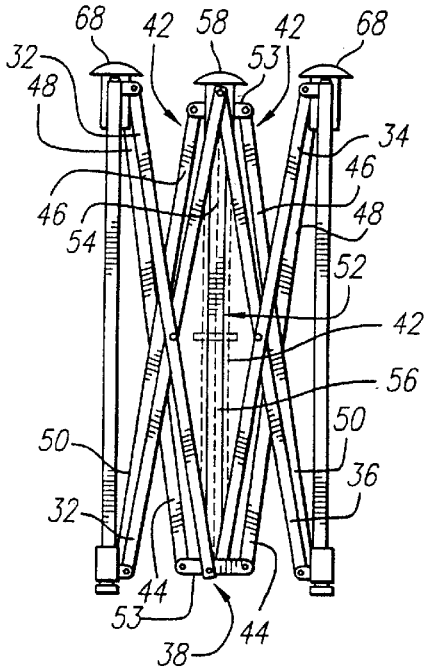
FIG. 3
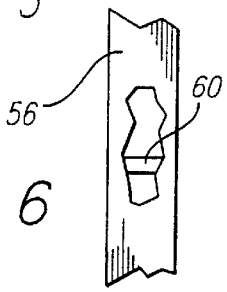
FIG. 6
FIG. 4
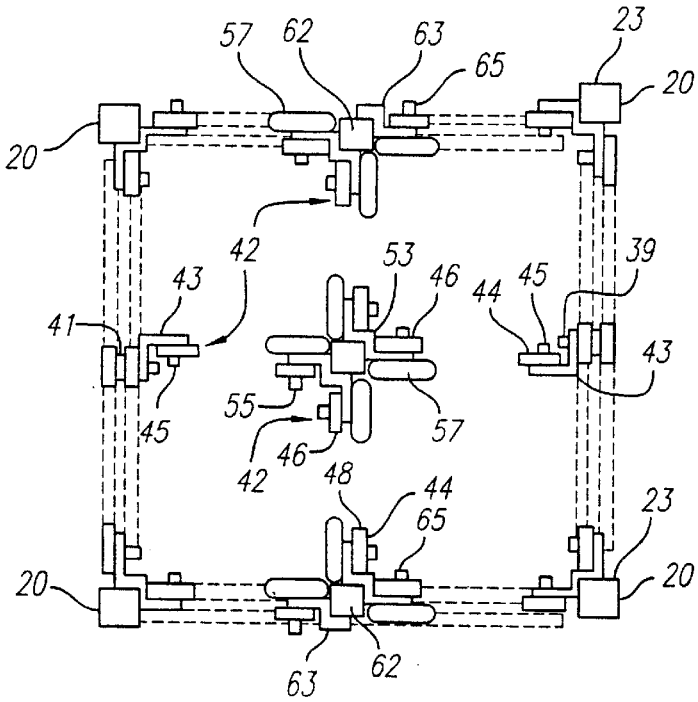
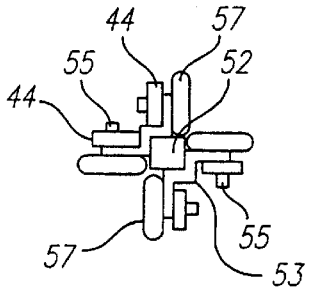
FIG. 5

ERECTABLE SHELTER WITH GABLE ROOF

This is a continuation of Ser. No. 09/503,376 filed Feb. 14, 2000, now U.S. Pat. No. 6,192,910, which is a continuation of Ser. No. 09/131,148 filed Aug. 7, 1998 (now U.S. Pat. No. 6,041,800).

BACKGROUND OF THE INVENTION

1. Field of the Invention

This invention relates generally to folding, collapsible structures, and more particularly relates to a collapsible, field shelter structure having an elevated canopy.

2. Description of Related Art

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One such quickly erectable, collapsible shelter having a framework of X-shaped linkages, telescoping legs, and a canopy covering the framework has legs that are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter. However, the height of the canopy is limited to the extended length of the legs, and the canopy is essentially flat, allowing for collection of precipitation and debris on top of the canopy, which can promote leaks and tears in the canopy.

It would be desirable to provide an improved collapsible shelter with a support framework for the canopy that rises above the supporting legs, to provide for more headroom within the structure, and to allow for a reduction in the size and weight of the legs and framework required to achieve an adequate height of the canopy. It would also be desirable to provide a canopy structure that is gabled to shed precipitation and debris from the top of the shelter. It would be further desirable to provide a shelter framework that would provide greater strength and stability, to allow support of larger, lighter collapsible shelter structures. The present invention meets these needs.

SUMMARY OF THE INVENTION

Briefly, and in general terms, the present invention provides for a collapsible shelter with an improved truss framework that raises a gabled shelter canopy to provide increased headroom, strength and stability.

The invention accordingly provides for a collapsible shelter having a collapsed configuration and an extended configuration, with a canopy that can be raised above the upper level of the leg assembly in an extended configuration. The canopy can have four or more sides and corners, and the leg assembly also has four or more legs supporting said canopy. A perimeter truss linkage assembly comprising a plurality of perimeter truss pairs of link members is connected to the leg assembly. In a presently preferred embodiment, each of the perimeter truss pairs includes first and second link members pivotally connected together in a scissors configuration, with the outer end of each first link member connected to the upper end of a leg, and the outer end of each second link slidably connected to the leg. Two or more central truss pairs of link members are provided, with each of the central truss pairs connected to the inner ends of one of the perimeter truss pairs on a side. Each of the central truss pairs preferably includes first and second link members pivotally connected together in a scissors configuration. At least three vertically oriented central support members for supporting the canopy above the upper level of the leg assembly are also provided, including at least one vertically oriented inner central support member, and at least two peripheral central support members. The inner ends of each of the first and second links of the central truss pairs are pivotally connected to the inner central support member, and the inner ends of each of the first and second links of the one of the perimeter truss pairs on one of the sides of the shelter are similarly pivotally connected to each peripheral central support member. In a presently preferred embodiment, the inner central support member comprises upper and lower telescoping sections, with the upper telescoping section having an upper end for supporting the canopy. The inner ends of each of the first links of the inner central truss pairs are pivotally connected to the upper telescoping section of the central support member, and the inner ends of each of the second links of the central truss pairs are pivotally connected to the lower telescoping section of the central support member. Similarly, each of the peripheral central support members has upper and lower telescoping sections, with the upper telescoping section having an upper end for supporting the canopy, and the inner ends of each of the first links of the perimeter truss pairs being pivotally connected to the upper telescoping section of the peripheral central support member, and the inner ends of each of the second links of the central truss pairs being pivotally connected to the lower telescoping section of the peripheral support member. Advantageously, in a preferred aspect of the invention, in each of the inner and peripheral central support members, the lower telescoping section has an internal stop member for supporting the upper telescoping section of the central support member, such that when the shelter is in the extended configuration, the lower telescoping section supports the upper telescoping section and raises the upper end of the upper telescoping section above the upper ends of the leg assembly.

These and other aspects and advantages of the invention will become apparent from the following detailed description and the accompanying drawings, which illustrate by way of example the features of the invention.

BRIEF DESCRIPTION OF THE DRAWINGS

FIG. 2 is a schematic diagram of a front side of the erectable, collapsible shelter of FIG. 1, in a collapsed configuration;

FIG. 3 is a schematic diagram of a left side elevational of the erectable, collapsible shelter of FIG. 1, in a collapsed configuration;

FIG. 4 is a sectional top view of the erectable, collapsible shelter of FIG. 1, in a collapsed configuration, taken along line 4—4 of FIG. 1;

FIG. 5 is a sectional bottom view of a portion of the inner central support member connection of the erectable, collapsible shelter of FIG. 1, in a collapsed configuration, taken along line 5—5 of FIG. 1;

FIG. 6 is a cutaway view of a portion of the lower telescoping section of a central support member of the erectable, collapsible shelter of FIG. 1.

DETAILED DESCRIPTION OF THE PREFERRED EMBODIMENTS

The size and available headroom of previous collapsible shelters have been generally limited by the extended length of the legs of the structure, and provided essentially flat roof structures, allowing for collection of precipitation in pockets or puddles on top of the shelter. The collapsible shelter of the invention provides for larger, lighter collapsible shelter structures, with a large raised gabled roof structure which also improves the strength and stability of the shelter.

Figure 1:
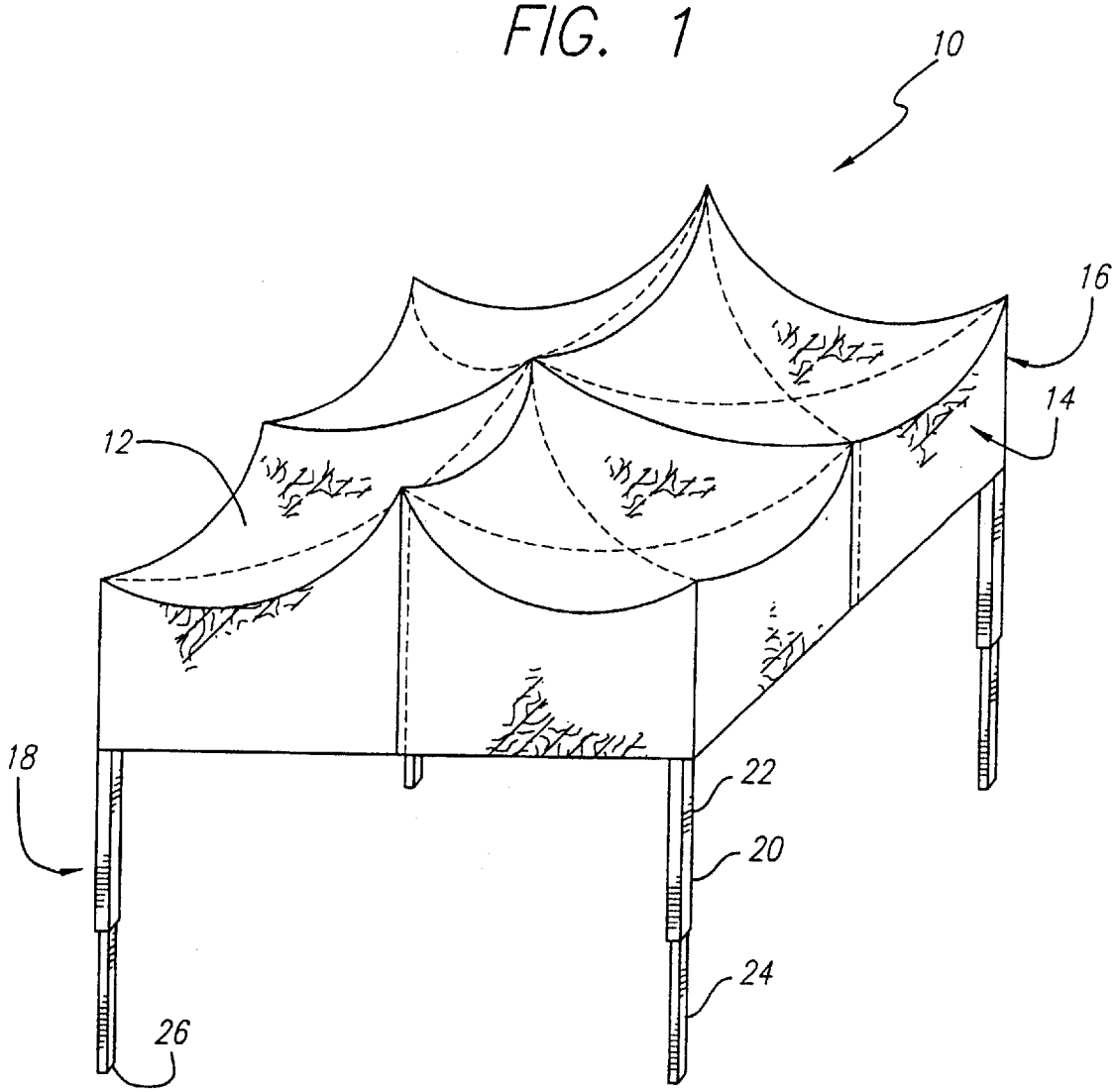
FIG. 1 is a perspective view of the erectable, collapsible shelter of the invention in an extended configuration.
Figure 7:
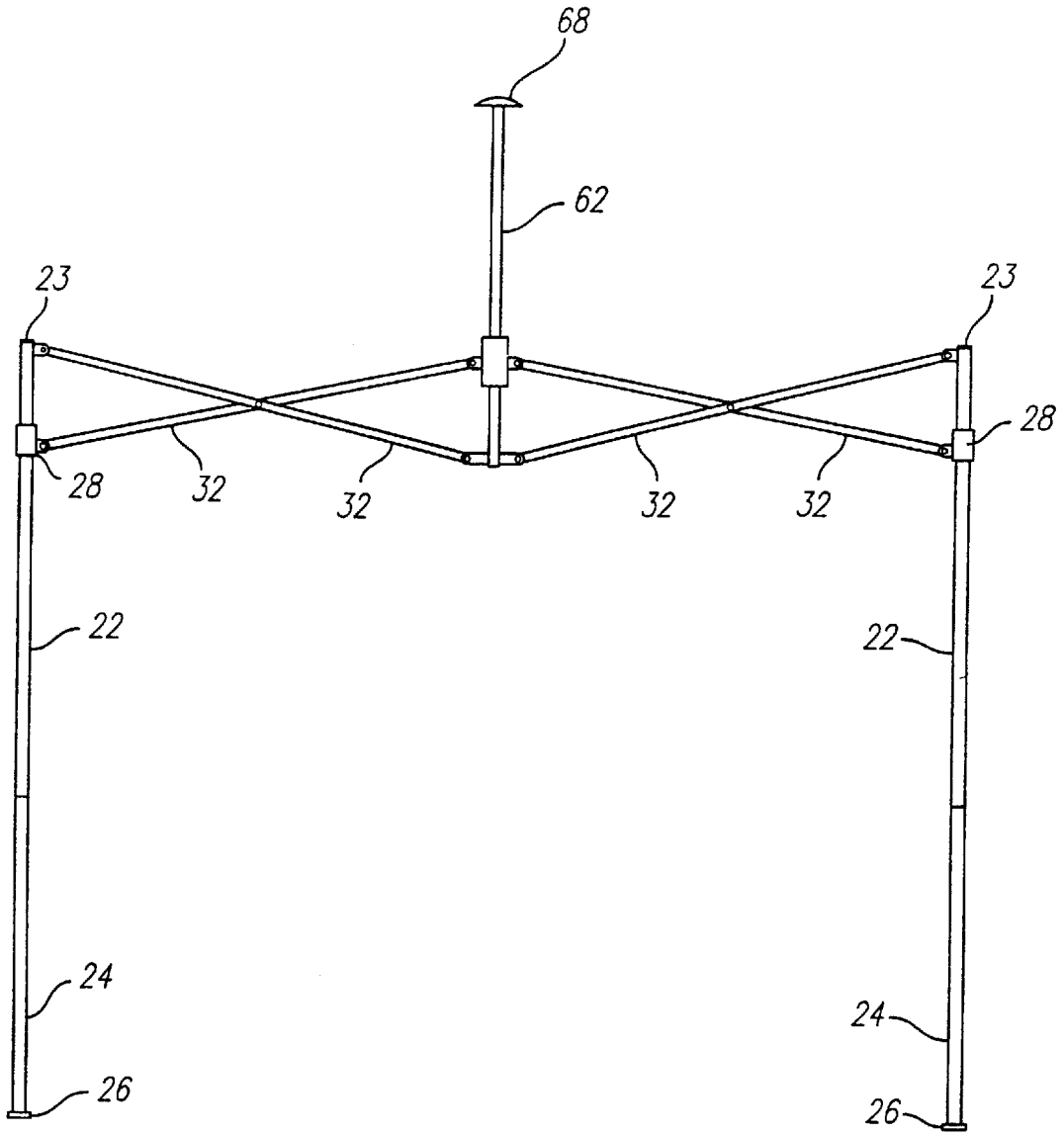
FIG. 7 is a schematic diagram showing the front side of the shelter corresponding to FIG. 2, in an extended configuration.
Figure 8:
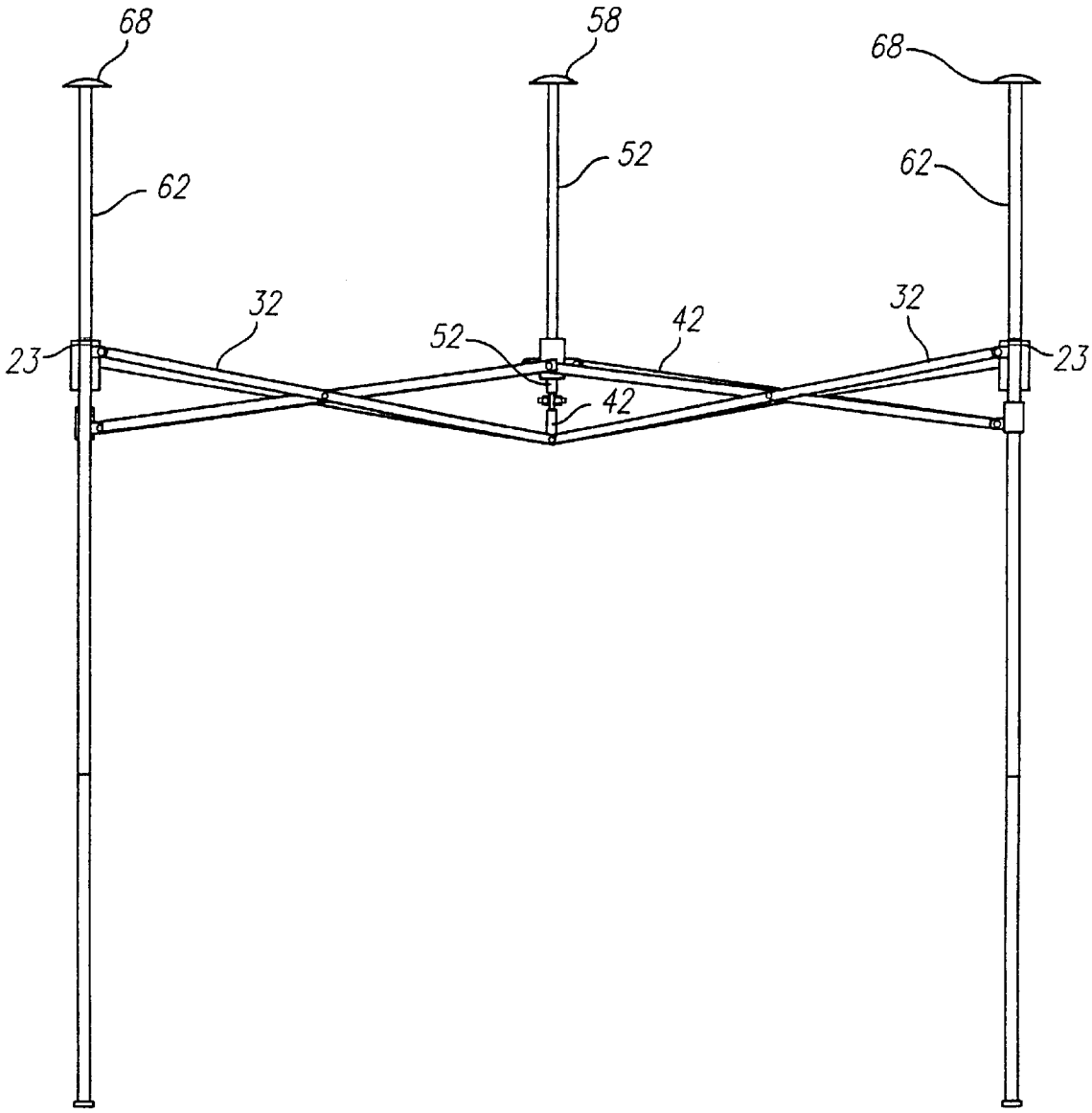
FIG. 8 is a schematic diagram showing the left side of the shelter in an extended configuration.

As is illustrated in the drawings, which are provided by way of example and not by way of limitation, the invention is embodied in an improved collapsible shelter 10 having an extended configuration illustrated in FIG. 1, for example, and a collapsed configuration shown in FIGS. 2 and 3. The improved collapsible shelter includes a canopy 12 having at least four sides 14 and four comers 16. As will become apparent, although the collapsible shelter illustrated in the drawings is generally square, it could also be rectangular, trapezoidal, six-sided, eight-sided, or the like.

The collapsible shelter includes a leg assembly 18 having at least four legs 20 supporting the canopy, and in a presently preferred embodiment, the legs are telescoping, and having an upper section 22 having an upper end 23, and a lower section 24 having a foot 26 for engagement with ground. In a preferred aspect of the invention a slider member 28 is slidably mounted to each of the legs, and is preferably mounted to the upper section of the legs.

The collapsible shelter also includes a perimeter truss linkage assembly 30 having a plurality of perimeter truss pairs of link members 32 connected to the leg assembly, with each of the perimeter truss pairs including first link members 34 and second 36 link members that are pivotally connected together in a scissors configuration. The first and second link members have an inner end 38 and an outer end 40, with the outer end of each of the first link members connected to the upper end of one of the legs, and the outer end of each second link member being connected to a slider member to slidably connect the second link member to the leg. The inner ends of the first link members are pivotally connected together, and the inner ends of the second link members are pivotally connected together, preferably by bolts 39 and spacers 41, on opposing sides of the shelter framework. At least two central truss pairs of link members 42 are provided, with each of the central truss pairs of link members being connected to the inner ends of one of the perimeter truss pairs on a side by brackets 43 and bolts 45. Each of the central truss pairs preferably includes first link members 44 and second 46 link members pivotally connected together in a scissors configuration. The first link members of the central truss pairs have an outer end 48 connected to the inner end of the second link member of the perimeter truss pair, and the second link members of the central truss pairs have an outer end 50 connected to the inner end of the first link member of the perimeter truss pair.

In a preferred aspect of the invention, the collapsible shelter includes at least one vertically oriented inner central support member 52 supporting the canopy. The inner ends of each of the first and second links of the central truss pairs are pivotally connected to the inner central support member by brackets 53 and bolts 55, preferably covered by protector members 57. In a presently preferred aspect of the invention, the inner central support member comprises upper 54 and lower 56 telescoping sections, with the upper telescoping section having an upper end 58 for supporting the canopy. The inner ends of each of the second link members of the central truss pairs are pivotally connected to the upper telescoping section of the central support member, and the inner ends of each of the first link members of the central truss pairs are pivotally connected to the lower telescoping section of the central support member. The upper telescoping section preferably slides within the lower telescoping section of the central support member, and the lower telescoping section advantageously has an internal stop member 60 mounted within the lower section generally above the middle of the lower telescoping section, as shown in FIGS. 3 and 6, for supporting the upper telescoping section, such that when the shelter is in the extended configuration, the lower telescoping section supports the upper telescoping section and raises the upper end of the upper telescoping section above the upper ends of the leg assembly.

Similarly, the collapsible shelter preferably includes at least two vertically oriented peripheral central support members 62 for supporting the canopy, with the inner ends of each of the first and second links of the one of the perimeter truss pairs on one of the sides of the shelter being pivotally connected to the peripheral central support member by brackets 63 and bolts 65. Each of the peripheral central support members is preferably formed from an upper telescoping section 64 slidably disposed in a lower telescoping section 66, with the upper telescoping section having an upper end 68 for supporting the canopy. The inner ends of each of the second link members of the perimeter truss pairs are likewise pivotally connected to the upper telescoping section of the peripheral central support member, and the inner ends of each of the first link members of the perimeter truss pairs are pivotally connected to the lower telescoping section of the peripheral support member. The lower telescoping section has an internal stop member 70, identified in FIG. 2, located similarly as in the inner central support member, as illustrated in FIG. 6, for supporting the upper telescoping section such that when the shelter is in the extended configuration, the lower telescoping section supports the upper telescoping section and raises the upper end of the upper telescoping section above the upper ends of the leg assembly.

It has thus been demonstrated that the invention provides for larger, lighter, and improved collapsible shelters with a large raised gabled roof structure which also improves the strength and stability of the shelter.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. In a collapsible shelter having a collapsed configuration and an extended configuration, the collapsible shelter including a canopy, a plurality of legs supporting said canopy, and a perimeter truss linkage assembly connected to said plurality of legs, the improvement comprising:

at least one vertically oriented inner central support member connected to said perimeter truss linkage assembly and supporting said canopy above said legs in said extended configuration; and at least two vertically oriented peripheral central support members connected to said perimeter truss linkage assembly and supporting said canopy above said legs in said extended configuration.

2. The collapsible shelter of claim 1, wherein said at least one inner central support member comprises upper and lower telescoping sections, said upper telescoping section having an upper end for supporting said canopy.

3. The collapsible shelter of claim 2, wherein said lower telescoping section has an internal stop member for supporting said upper telescoping section, such that when said shelter is in said extended configuration, said lower telescoping section supports said upper telescoping section and raises said upper end of said upper telescoping section above the upper ends of said legs.

4. The collapsible shelter of claim 1, wherein each of said peripheral central support members comprises upper and lower telescoping sections.

5. The collapsible shelter of claim 4, wherein said lower telescoping section has an internal stop member for supporting said upper telescoping section such that when said shelter is in said extended configuration, said lower telescoping section supports said upper telescoping section and raises said upper end of said upper telescoping section above the upper ends of said legs.

* * * * *